US007069974B2

(12) United States Patent
Rittner et al.

(10) Patent No.: US 7,069,974 B2
(45) Date of Patent: Jul. 4, 2006

(54) METHOD AND DEVICE FOR PRODUCING THIN SLABS

(75) Inventors: Karl Rittner, Hilden (DE); Jürgen Müller, Kaarst (DE); Fernando Vergniory, Santa M de Guecho (ES); Armando Villareal Gutiérrez, Castro Urdiales (ES); Pedro Sagasti, Las Arenas (ES)

(73) Assignees: SMS Demag AG, Düsseldorf (DE); Aceria Compacta de Bizkaia S.A., Sestao (ES)

( * ) Notice: Subject to any disclaimer, the term of this patent is extended or adjusted under 35 U.S.C. 154(b) by 0 days.

(21) Appl. No.: 10/416,985

(22) PCT Filed: Nov. 16, 2001

(86) PCT No.: PCT/EP01/13229

§ 371 (c)(1),
(2), (4) Date: Sep. 3, 2003

(87) PCT Pub. No.: WO02/40201

PCT Pub. Date: May 23, 2002

(65) Prior Publication Data

US 2004/0035550 A1 Feb. 26, 2004

(30) Foreign Application Priority Data

Nov. 16, 2000 (DE) ..... 100 57 160

(51) Int. Cl.
*B22D 11/12* (2006.01)

(52) U.S. Cl. ..... 164/454; 164/484

(58) Field of Classification Search ..... 164/454, 164/413, 442, 441, 484
See application file for complete search history.

(56) References Cited

U.S. PATENT DOCUMENTS

| | | | | |
|---|---|---|---|---|
| 5,577,548 | A | 11/1996 | Hohenbichler et al. | |
| 5,853,043 | A | 12/1998 | Takeuchi et al. | |
| 6,102,101 | A * | 8/2000 | Hanazaki et al. | 164/452 |
| 6,612,364 | B1 * | 9/2003 | Streubel | 164/476 |
| 6,701,999 | B1 * | 3/2004 | Von Wyl et al. | 164/484 |
| 6,712,123 | B1 * | 3/2004 | Weyer et al. | 164/454 |

FOREIGN PATENT DOCUMENTS

| | | |
|---|---|---|
| DE | 4436328 | 4/1995 |
| DE | 4403048 | 7/1995 |

(Continued)

OTHER PUBLICATIONS

Patent abstracts of Japan, vol. 017, No. 284 (M-1421), May 31, 1993 & JP 05 015956 A (Kobe Steel Ltd), Jan. 26, 1993.

*Primary Examiner*—Len Tran
(74) *Attorney, Agent, or Firm*—Friedrich Kueffner

(57) ABSTRACT

A method for producing thin slabs whereby the cross-section thereof is reduced during solidification in a continuous casting device wherein the strand guide adjacent to the mold includes wedge-shaped adjustable roller-strand sections for regulating the thickness of the strand or the thin slabs. The thickness of the strand is reduced only on one point of the strand guide below the first segment downstream from the mold in an area of the strand containing a liquid core by regulating the strand guide rollers with a soft transition. The segment following the segment situated directly after the mold comprises a pivoting point on the input side and an adjusting means arranged on the output side.

2 Claims, 3 Drawing Sheets

FOREIGN PATENT DOCUMENTS

| | | |
|---|---|---|
| DE | 196 39 297 A1 | 3/1998 |
| EP | 0329639 | 8/1989 |
| EP | 0450391 | 10/1991 |
| EP | 0611610 | 8/1994 |
| WO | 9850185 | 11/1998 |

* cited by examiner

METHOD AND DEVICE FOR PRODUCING THIN SLABS

BACKGROUND OF THE INVENTION

1. Field of the Invention

The invention concerns a process and equipment for producing thin slabs, whose cross section is reduced during solidification, in a continuous casting plant, whose strand guide following the mold has wedge-shaped, adjustable roll sections or strand segments for regulating the thickness of the strand or thin slab.

2. Description of the Related Art

It is known from EP 0 450 391 B1 that, in a thin slab casting machine, to support the cast strand, especially for soft reduction, symmetrically opposite roll supports can be provided below the continuous casting mold on both sides of the cast strand, the rolls of which are in working connection with the strand. Each roll support is mounted in a stationary frame and divided into segments that support several rolls, and each segment has adjusting devices. The roll-supporting segments are flexibly coupled with one another in such a way that each segment can be set and adjusted individually at any desired angle to the strand. Mechanical, hydraulic, or mechanical-hydraulic adjusting devices are used for this purpose.

DE 196 39 297 A1 describes a process and equipment for high-speed continuous casting plants with strand thickness reduction during solidification. The strand cross section is linearly reduced over a minimum length of the strand guide immediately below the mold. With the following further reduction of the strand cross section over the remainder of the strand guide (soft reduction) until at most immediately before the final solidification or the tip of the liquid crater of the liquid core, a critical deformation of the strand is avoided, taking into account the casting rate and the steel grade. EP 0 611 610 A1 also describes strand casting with distribution of the thickness reduction over the length of the strand guide, in which the casting of the strand is additionally followed by hot rolling of the slabs previously cut off from the strand.

SUMMARY OF THE INVENTION

The object of the invention is to develop a process and equipment of the type mentioned at the beginning, which allow optimized LCR (liquid core reduction) and reduce plant expenses.

In accordance with the invention, this object is achieved with a process for thin slabs in the thickness range of about 40–120 mm, in which the strand thickness is reduced only at a point of the strand guide below the first segment downstream of the mold in a region of the strand that has a liquid core by wedge-taper adjustment of the strand guide rolls there with a soft transition. This puts into practice the recognition, based on extensive operational experience, that, in the case of small thickness reductions, it is sufficient to act on the strand at only one point of the strand guide. Thus, it is no longer necessary to provide all segments with regulating or adjusting devices, which otherwise would require high capital costs and maintenance expense.

In any case, above all, at least the first segment immediately following the mold can be designed in a simple and maintenance-friendly way. The simple design of the first segment is especially advantageous due to the high risk of breakouts there, particularly if special steel grades, e.g., high-grade steels, are being cast. Furthermore, in the case of modernization, the simple design of the segments located between the mold and the reduction region makes it possible to retain the existing segments for this strand guide region, which limits the modernization costs only to a partial area of the continuous casting machine or plant and thus lowers the capital costs. In addition, an operation of the continuous casting plant can be realized, in which the liquid crater or liquid core can be shifted as far as possible towards the bottom, and a final solidification can always be achieved in the same region of the strand guide. This is independent of the given width of the strand that is about to be cast and of the casting rate.

In accordance with a proposal of the invention, the thickness is reduced in the range of 1–25 mm, depending on the casting format and the exact location of the adjusted segment performing the mini-reduction within the strand guide. The concrete location of the occurrence of the action on the strand is thus crucial to the corresponding degree of thickness reduction to be carried out.

In accordance with the invention, the equipment for carrying out the process has a pivoting point on the run-in side in a segment following the segment located directly after the mold and preferably load-regulated and/or position-regulated adjusting devices on the runout side. At least the first segment following the mold is thus not used for the thickness reduction and thus remains in its original parallel position of the strand guide, so that no hydraulic regulating devices are needed for this segment. For the following segment that is to be wedge-adjusted at one point in the strand guide, a simpler and less time-consuming wedge adjustment is achieved than in the case of a total wedge adjustment by adjusting devices due to the pivoting point on the run-in side.

A preferred embodiment of the invention provides that the segment performing the mini-reduction is subdivided, and only the strand guide rolls located in the upper partial segment are adjusted against the strand. This partial segment, which then has the pivoting point at the top and the adjusting device or devices on the runout side, means that the wedge adjustment is always followed by still another parallel section of the strand guide, even when the wedge adjustment occurs in the last segment of the strand guide.

In accordance with a proposal of the invention, adjusting cylinders located on the movable side are assigned to the driven rolls of the bending driver that follow the segments of the strand guide. These cylinders located on the movable side (in continuous casting plants, the fixed side is generally located in the direction of the turret supplying the ladles with the molten steel) produce the advantage that they automatically adjust to the thickness of the strand.

Further details of the invention are revealed by the following description of the embodiments illustrated in the drawings.

DETAILED DESCRIPTION OF THE INVENTION

Figure 1:
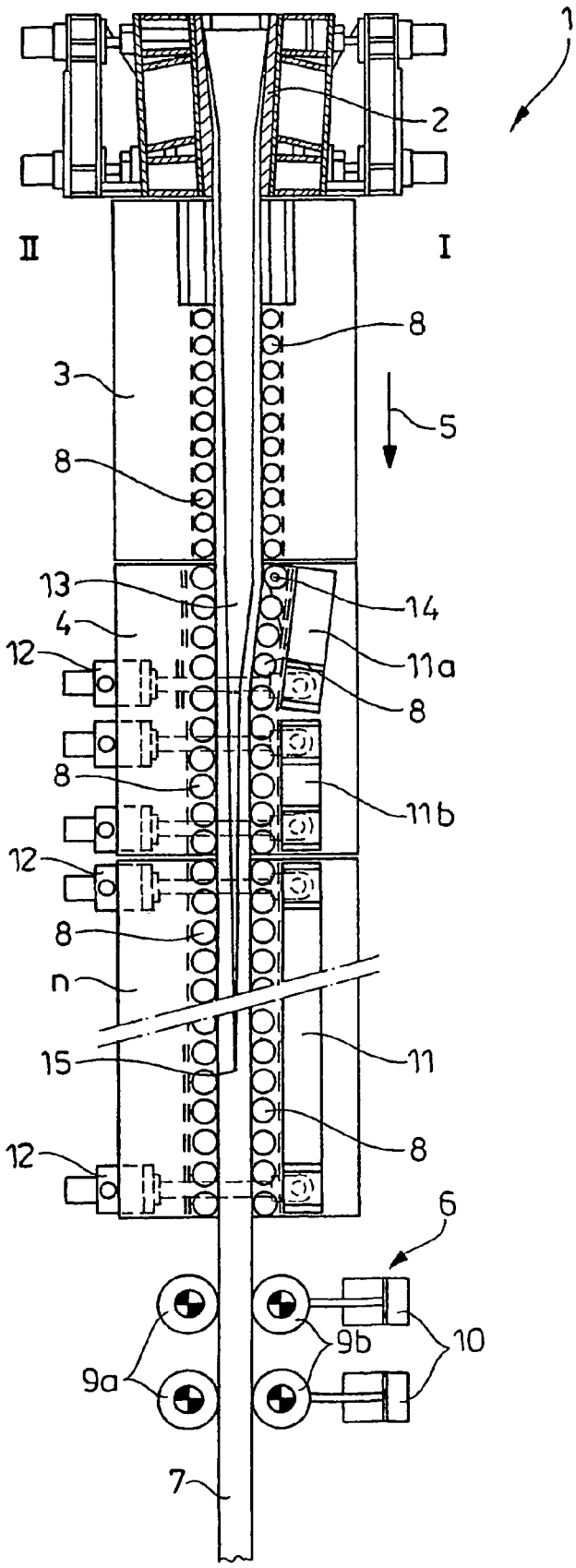
FIG. 1 is a schematic representation of a continuous casting plant, which shows a continuous mold, followed by a strand guide, with thickness reduction occurring in the second segment of the strand guide.
Figure 2:
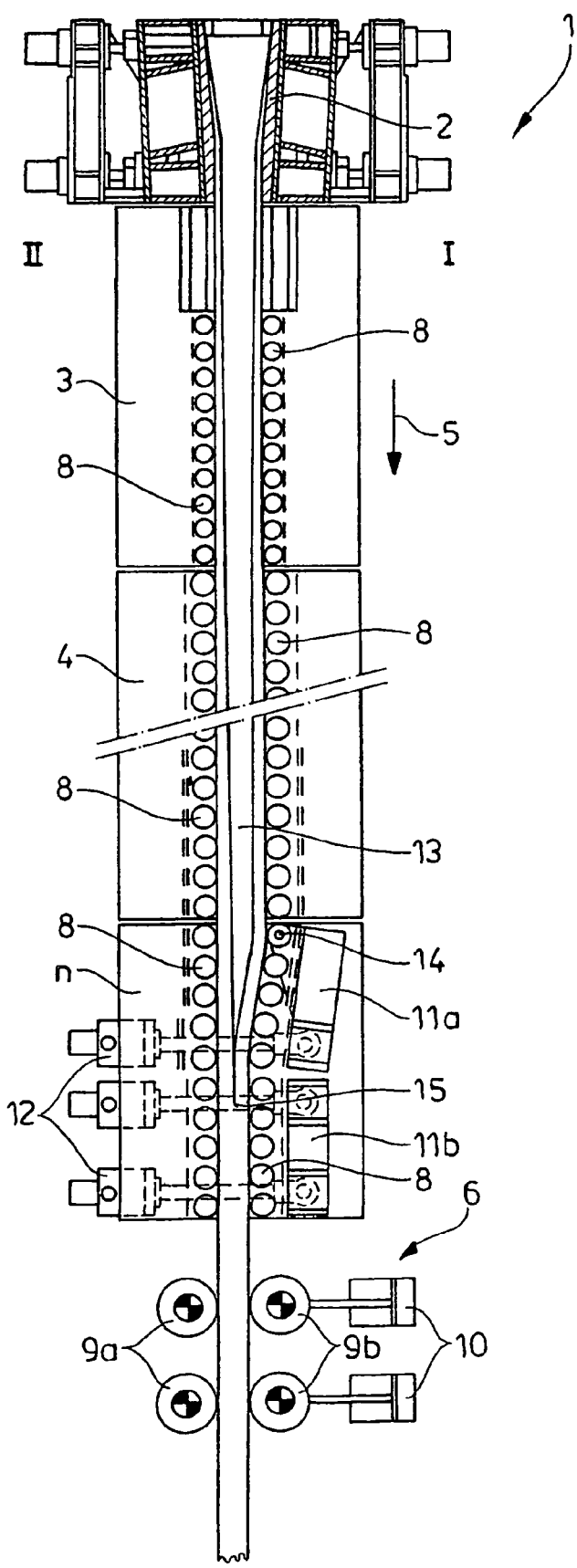
FIG. 2 shows a plant similar to FIG. 1 with thickness reduction carried out in the upper section of the last segment of the strand guide.
Figure 3:
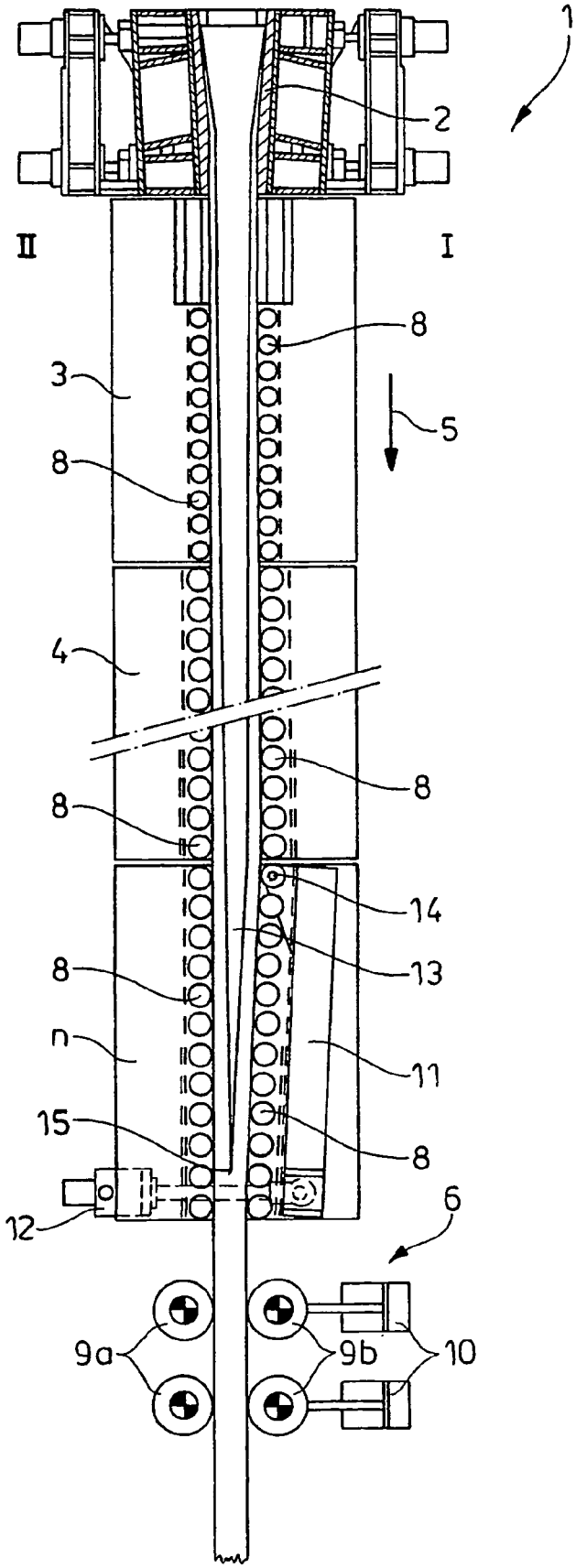
FIG. 3 shows a plant similar to FIG. 2 with the thickness reduction carried out by a wedge adjustment of the entire last segment of the strand guide.

FIGS. 1 to 3 show a continuous casting plant 1 with its oscillatingly driven mold 3, the strand guide, which consists of several segments 3, 4, and n, and the bending driver 6, which follows the strand guide in the direction 5 of withdrawal. The segments 3, 4, and n are provided with numerous guide rolls 8 that support the strand 7. The bending driver 6 has successive driven rolls 9*a*, 9*b* arranged opposite each other in pairs, and hydraulic adjusting cylinders 10 are assigned to each of the bending driver rolls 9*b* located on the movable side I of the continuous casting plant 1. Operating cylinders 12, whose piston rods act on roll supports 11, 11*a*, and 11*b*, are assigned to some of the segments of the strand guide.

In the embodiment shown in FIG. 1, the mini-reduction in the thickness of the strand 7 is carried out in the area of the liquid core 13 directly in the segment 4 following the first segment 3, specifically, only by means of the roll support 11*a* of this segment 4, which is divided into two functional sections. The roll support 11*a* has a pivoting point 14 on the run-in side and is pivoted into the indicated wedge adjustment position for thickness reduction of the strand 7 by the operating cylinder 12, which acts at the bottom of the roll support 11*a*. A parallel segment adjustment that continues over a very long interval and thus a large operating window is achieved by means of the operating cylinders 12 acting on the roll supports 11*b*—or on the roll support or supports 11 of the following partial segment or subsequent segments n. The final solidification (cf. the tip of the liquid crater) of the strand 7 occurs in the area of the last segment n, but, of course, it can simply move further up or down over a large range, depending on the particular casting conditions and preset values.

In contrast to the embodiment described above, in FIG. 2 the last segment n of the strand guide is subdivided, and the upper roll support 11*a* is wedge-adjusted about the pivoting point 14. A well-defined operating window with equal strand thickness and end solidification (tip of the liquid crater 15) in the last segment n of the strand guide is thus present in this case, although, of course, the following parallel interval is very much shorter here. Another variation of the thickness reduction of the strand with an otherwise unchanged operational start is shown in FIG. 3. In this case, the entire roll support 11 of the last segment n of the strand guide is wedge-adjusted by pivoting about the pivoting point 14. Although an exactly targeted final solidification (cf. tip of the liquid crater 15) is problematic, nevertheless, it is in any case guaranteed that the final solidification takes place in the same area as in all of the other embodiments, namely, in the last segment n.

A common feature of all of the embodiments is that at least the first segment 3 after the mold 2 (and, in accordance with FIGS. 2 and 3, the subsequent segment or segments 4) can be managed without hydraulic adjusting devices, which significantly reduces the capital costs and maintenance expense. A maintenance-friendly design of the continuous casting plant and its strand guide is thus achieved, especially for the first segment 3, which is at especially high risk for breakouts.

The invention claimed is:

1. A method of producing thin slabs whose cross-section is reduced during solidification, in a continuous casting plant having a strand guide means following the mold, the strand guide means including a plurality of adjustable guide roll segments each with a plurality of pairs of guide rolls, wherein only one of the guide roll segments is used for regulating the thickness of the thin slab, the method comprising reducing the strand thickness in only one guide roll segment of the strand guide means below a first of the guide roll segments downstream of the mold in a region of the thin slab that has a liquid core, by adjusting the angle of the guide rolls in the guide roll segment below the first guide roll segment downstream of the mold, whereby a soft transition and a mini-reduction are achieved.

2. The method according to claim 1, comprising, depending on a casting format and an exact location of the adjusted guide roll segment, performing the reduction of the thin slab in a range of 1–25 mm.

* * * * *